US010669117B2

(12) United States Patent
Hunt

(10) Patent No.: US 10,669,117 B2
(45) Date of Patent: Jun. 2, 2020

(54) PORTABLE ROPE GUIDING APPARATUS

(71) Applicant: Kenneth Hunt, Carlsbad, CA (US)

(72) Inventor: Kenneth Hunt, Carlsbad, CA (US)

( * ) Notice: Subject to any disclaimer, the term of this patent is extended or adjusted under 35 U.S.C. 154(b) by 0 days.

(21) Appl. No.: 15/820,238

(22) Filed: Nov. 21, 2017

(65) Prior Publication Data

US 2019/0152737 A1 May 23, 2019

(51) Int. Cl.
*B65H 51/10* (2006.01)
*B65H 57/14* (2006.01)
*B65H 51/06* (2006.01)

(52) U.S. Cl.
CPC ..... *B65H 51/10* (2013.01); *B65H 51/06* (2013.01); *B65H 57/14* (2013.01); *B65H 2701/35* (2013.01)

(58) Field of Classification Search
CPC .... B65H 51/10; B65H 57/14; B65H 2701/35; B65H 2402/44; B65H 2402/41; B65H 2402/412; B65H 2402/42; B65H 75/305; B66D 3/26; B66D 1/28
USPC ..... 254/371, 380
See application file for complete search history.

(56) References Cited

U.S. PATENT DOCUMENTS 2,670,926 A * 3/1954 Sewell ..... B65H 51/10 226/186
4,165,830 A * 8/1979 Svendsen ..... B65H 75/364 226/187
4,383,516 A * 5/1983 La See ..... F41B 5/1488 124/80
4,415,140 A * 11/1983 Deering ..... A01K 73/06 226/183
4,598,442 A * 7/1986 Luginbuhl ..... F16G 11/101 24/132 R
4,846,075 A * 7/1989 Tupper ..... A62B 1/14 104/209
5,139,751 A * 8/1992 Mansfield ..... B05B 13/06 118/306
5,996,971 A * 12/1999 Crouse ..... E21B 19/22 254/362
6,209,852 B1 * 4/2001 George ..... B66D 3/18 254/270
6,412,602 B1 * 7/2002 Sundman ..... A62B 1/14 182/133
6,796,522 B2 * 9/2004 Braun ..... A62B 1/06 226/177
7,934,698 B2 * 5/2011 Ball ..... B66D 1/7415 182/133

(Continued)

*Primary Examiner* — Michael C McCullough
(74) *Attorney, Agent, or Firm* — Mintz, Levin, Cohn, Ferris, Glovsky and Popeo, P.C.; Paul Brockland

(57) ABSTRACT

A portable rope drive and guiding apparatus operable by a single user is disclosed. The apparatus includes a receptacle defined by a first side wall, a second side wall, a first end wall and a second end wall, with a vertical opening between a top edge and a bottom edge for receiving the rope. The apparatus further includes a powered drive wheel mounted between the first side wall and the second side wall, and having a friction-bearing outer perimeter to drive the rope through the receptacle. The apparatus further include a guide wheel mounted between the first side wall and the second side wall, opposite the drive wheel, the guide wheel having a concave outer perimeter that corresponds to and guides the rope through the receptacle as the rope is driven by the drive wheel.

16 Claims, 3 Drawing Sheets

(56) References Cited

U.S. PATENT DOCUMENTS

| | | | | |
|---|---|---|---|---|
| 9,043,999 | B1 * | 6/2015 | Boester | A01K 89/02 |
| 9,427,606 | B2 * | 8/2016 | Ball | A62B 1/06 |
| 9,750,959 | B2 * | 9/2017 | Sepe | A62B 1/14 |
| 9,850,113 | B2 * | 12/2017 | Melin | B66D 3/20 |
| 2008/0185564 | A1 * | 8/2008 | LaFreniere | B66D 3/18 254/342 |
| 2017/0341900 | A1 * | 11/2017 | Sherril | B65H 51/10 |

* cited by examiner

PORTABLE ROPE GUIDING APPARATUS

BACKGROUND

Ropes are well known tools used in a variety of applications. In particular, ropes are extensively used in firefighting and lifesaving applications, where they must be quickly accessed and deployed in what is usually an emergency situation. Ropes are also used extensively in rock climbing or mountain climbing. Once the situation is under control, or an ascent or descent completed, however, a used rope must be returned to its container in a condition that will allow it to be accessed again with the same swiftness and efficiency as before.

Repacking a rope can be a laborious process, requiring at least two, and maybe more, persons. Used ropes can pick up a lot of dirt or water, and may get tangled or knotted up when used. Thus, having to guide a rope under such conditions can be very time consuming and difficult, usually requiring the coordinated efforts of multiple persons.

What is needed is a way that a single person can efficiently and effectively guide a rope to a desired location.

SUMMARY

This document presents a portable rope guiding apparatus and system, which enables a single user to efficiently and effectively guide a rope to a desired location, such as a pouch or other container.

In accordance with implementations described herein, a portable rope drive and guiding mechanism can be operable by a single user. The mechanism can include a receptacle defined by a first side wall, a second side wall, a first end wall and a second end wall, the second side wall having a vertical opening between a top edge and a bottom edge, the vertical opening providing a first side portion and a second side portion of the second side wall. The mechanism can further include a drive wheel mounted between the first side wall and the first side portion of the second side wall by a first axle, the drive wheel having a friction-bearing outer perimeter to drive the rope through the receptacle, the first axle having a drive shaft extending from either the first side wall or the second side wall to drive the drive wheel.

The mechanism can further include a guide wheel mounted between the first side wall and the second side portion of the second side wall, opposite the vertical opening from the drive wheel, by a second axle, the guide wheel having a concave outer perimeter that corresponds to and guides the rope through the receptacle as the rope is driven by the drive wheel. The mechanism can further include one or more handles extending from the first end wall and/or the second end wall.

The portable rope drive and guiding mechanism can be used in a variety of applications, such as in emergency and rescue services, mountain climbing, rock climbing, repelling, towing, or even after using a rope for securing an object from falling or becoming unstable.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a portable rope guiding apparatus that can be operated by a single user. The portable rope guiding apparatus can be held by the single user, typically in one hand, while the other hand of the user can feed the rope into the apparatus for guiding the rope therethrough. In alternative implementations, the apparatus can include a harness or mount for being mounted to clothing or a harness worn by the single user, to enable both hands of the user to be free to feed the rope and/or operate the apparatus.

As will be discussed in further detail below, a preferred implementation, and operation thereof, includes the user holding a handle extending from the apparatus, while, after feeding the rope into the apparatus, the user operates a motor or driving mechanism to drive a drive wheel or drive cam to drive the rope through the apparatus where it can be, among other applications, fed into a storage compartment such as a bag or a box.

In still other alternatives, the apparatus can be configured to wring a rope of water that has been absorbed by the rope, and/or clean an outer surface of the rope of dirt or other particles that have attached to the outer surface of the rope. Importantly, the use of the apparatus ensures that the rope is fed out of the apparatus without knots or twists, etc. which complicate the storing and later use of the rope.

Figure 1:
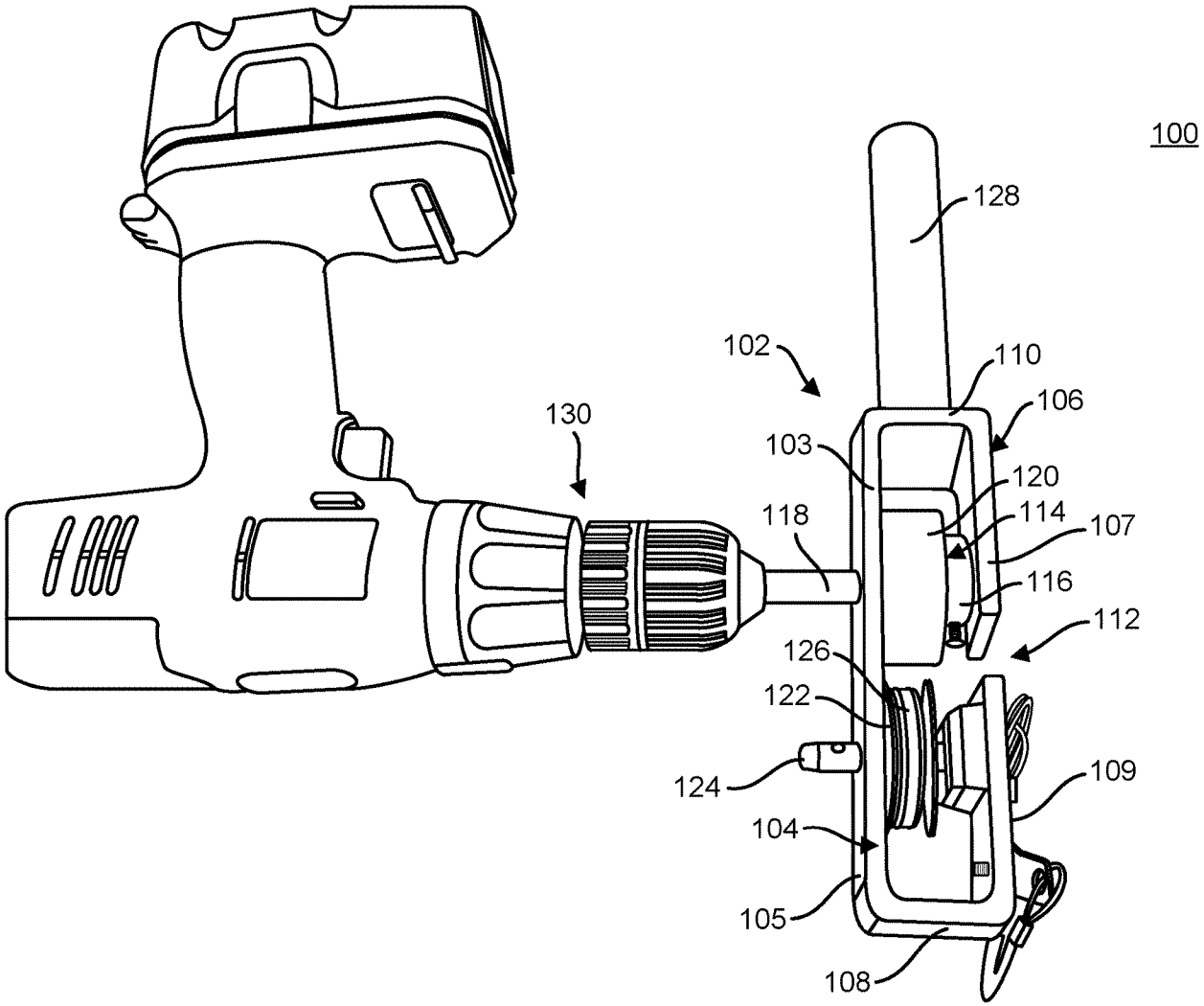
FIG. 1 is a top perspective view of a portable rope guiding apparatus in accordance with implementations of the subject matter described herein.

In preferred, exemplary implementations, as represented in FIG. 1, an apparatus 100 includes a receptacle 102 that is defined by a first side wall 104, a second side wall 106, a first end wall 108 and a second end wall 110. The second side wall 106 includes a vertical opening 112 between a top edge 103 and a bottom edge 105 of the second side wall 106. The vertical opening 112 thus provides and defines a first side portion 107 and a second side portion 109, opposite the vertical opening 112, of the second side wall 106. The vertical opening 112 is provided at substantially a midpoint of the second side wall 106, and is sized and configured to allow the rope to be placed therethrough.

The apparatus 100 further includes a drive wheel 114 mounted between the first side wall 104 and the first side portion 107 of the second side 106 wall by a first axle 116. The drive wheel 114 has a friction-bearing outer perimeter 120 to drive the rope through the receptacle 102. The friction-bearing outer perimeter 120 can include an elastomer, such as rubber, foam, a polymerized plastic material, or the like. The first axle 116 includes and is coupled with a drive shaft 118 extending from either the first side wall 104 of the receptacle 102 or the second side wall 106 of the receptacle 102 to drive the drive wheel 114. The drive shaft 118 is configured to receive motive force from an external drive motor 130, such as from a handheld drill or a motor directly mounted to the receptacle 102.

The drive motor 130 is operable either directly by a control button on the drive motor 130, or remotely from a controller placed elsewhere on the single user or even remote from the single user. For instance, the drive motor 130 can include a transceiver for receiving control signals via a wireless communication channel, employing a wireless communication protocol such as WiFi, Bluetooth, or Zigbee, for example. The wireless communication protocol can preferably be compliant with any of a number of IEEE 802 standards. The control signals can be transmitted from a handheld remote controller, from a mobile computing device, or from a controller integrated with the apparatus 100 itself.

The apparatus 100 further includes a guide wheel 122 mounted between the first side wall 104 and the second side portion 109 of the second side wall 106, opposite the vertical opening 112 from the drive wheel 114. The guide wheel 122 is mounted by a second axle 124. The second axle 124 can be an axle mounted between two bearings, and/or may include a detachable mounting pin. The guide wheel 122 is configured to guide the rope through the receptacle 102 as the rope is driven by the drive wheel 114. The guide wheel 122 preferably includes a concave outer perimeter 126 that corresponds to and guides the rope. As such, a concavity of the outer perimeter 126 of the guide wheel 122 can match or correspond to a diameter, or a portion of the circumference, of the rope. In some implementations, the outer perimeter 126 can be coated at least partially by a friction-forming material, such as rubber or nylon, which better adheres with the rope as the rope is guided by the guide wheel 122.

It should be understood that the first side wall 104 and the second side wall 106, as well as the corresponding drive wheel 114 and the guide wheel 122 can be swapped and/or interchangeable. In some implementations, the guide wheel 122 and/or drive wheel 114 can incorporate one or more sensors to sense or detect a presence of a rope, particular when the rope is placed between the guide wheel 122 and the drive wheel 114, which detection can automatically initiate, activate or control the drive motor 130. The one or more sensors can include, without limitation, a pressure sensor, and optical sensor, a motion sensor, or other sensor.

In some implementations, the apparatus 100 can include one or more handles 128 extending from the first end wall 108 and/or the second end wall 110, and/or even from first side wall 104 and/or second side wall 106. The handles 128 can be sized and adapted to be gripped by at least one hand of the single user, for controlling the positioning and orientation of the apparatus 100. In alternative implementations, the receptacle 102 can include a mounting mechanism for mounting to the body of the single user, either to a harness or outer mount, or to the clothing of the single user.

In yet other implementations, the apparatus 100 can include a rope guide 150 to guide the rope or line through the receptacle 102 and/or the guide wheel 122 and/or drive wheel 114. The rope guide 150 can be repositionable so as to allow either right-handed or left-handed use of the one or more handles 128.

Figure 2:
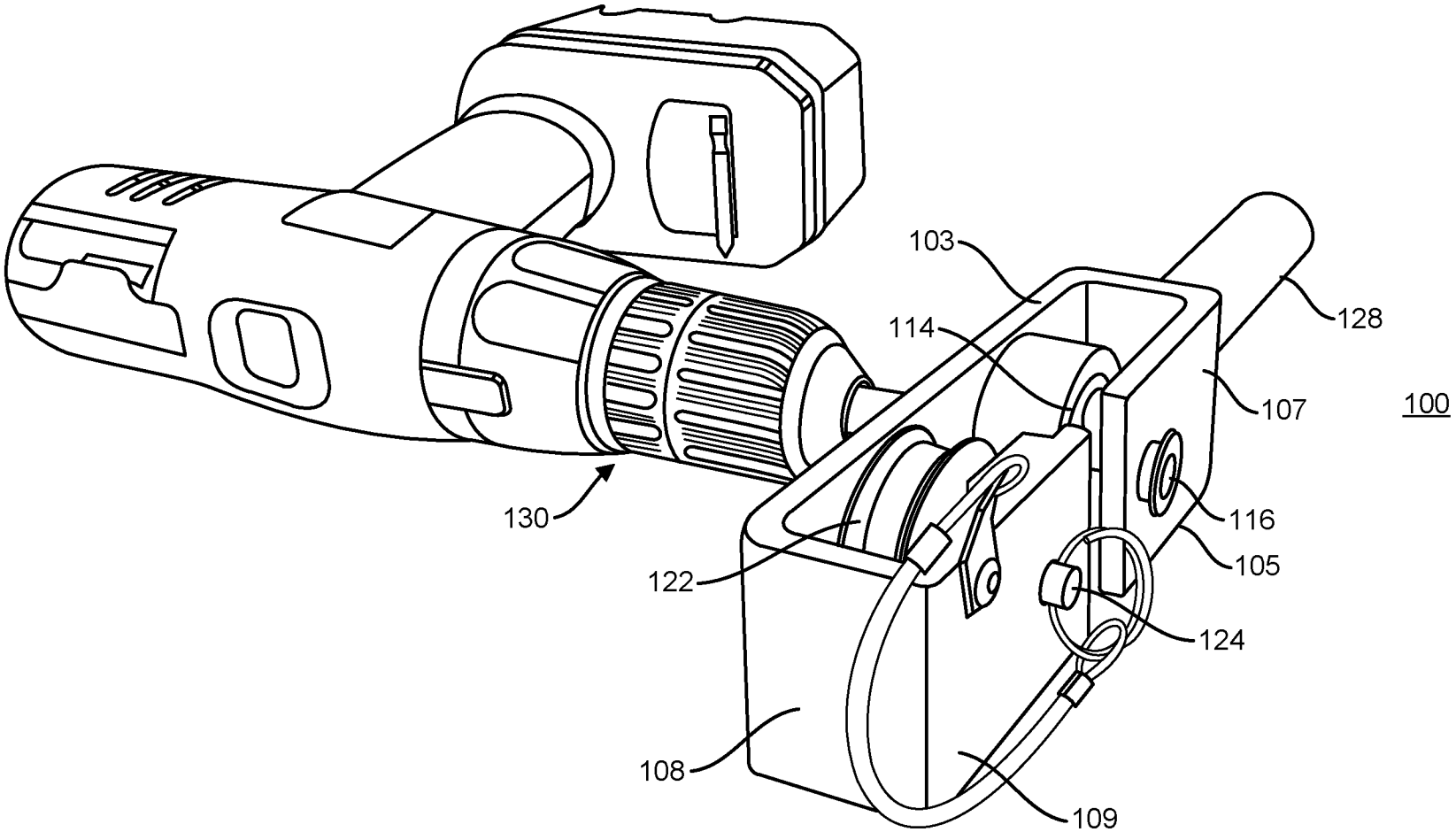
FIG. 2 is a side perspective view of a portable rope guiding apparatus in accordance with implementations of the subject matter described herein.
Figure 3:
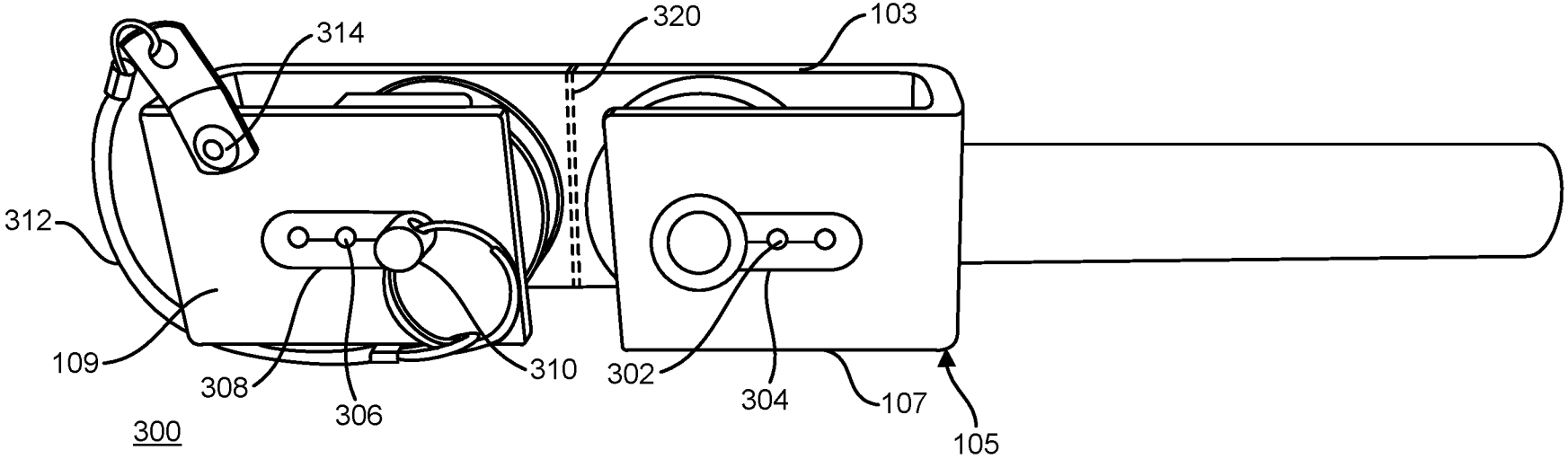
FIG. 3 is a front perspective view of a portable rope guiding apparatus in accordance with implementations of the subject matter described herein.

FIG. 3 is a side perspective view of a portable rope guiding apparatus 300 having features substantially identical to the apparatus shown in FIGS. 1 and 2. However, to accommodate ropes of different sizes and diameters, one or both of the first and second axles on which the drive wheel and guide wheel are mounted, respectively, can be mounted into one of two or more holes 302 and 306, respectively. Or, a space between the drive wheel and guide wheel can be adjustable such as, for example, a first movable positioning mechanism 304 that allows the drive wheel to move away from or closer toward the guide wheel. The positioning mechanism can be biased by a spring or other biasing mechanism toward the guide wheel, or it can be locked into one of a number of places along the first side portion 107 of the second side wall. Likewise, a second movable positioning mechanism 308 can be used to allow the guide wheel to move away from or closer toward the drive wheel, and can also include a biasing mechanism and/or locking mechanism.

In other implementations, the apparatus 300 can include a first side wall having a connecting bridge 320 that can be pulled apart to widen the space or gap between the drive wheel and the guide wheel, or pushed inward to narrow the space between the drive wheel and the guide wheel. In these implementations, the first and second axles, as well as the drive wheel and the guide wheel, are preferably fixed between the first side wall and the second side wall.

Although a few embodiments have been described in detail above, other modifications are possible. Other embodiments may be within the scope of the following claims.

The invention claimed is:

1. A portable rope drive and guiding apparatus operable by a single user, the apparatus comprising:

a receptacle defined by a first side wall, a second side wall, a first end wall and a second end wall, the second side wall having a vertical opening between a top edge and a bottom edge, the vertical opening providing a first side portion and a second side portion of the second side wall;

a drive wheel mounted between the first side wall and the first side portion of the second side wall by a first axle, the drive wheel having a friction-bearing outer perimeter to drive the rope through the receptacle, the first axle having a drive shaft extending from either the first side wall or the second side wall to drive the drive wheel, the drive shaft configured to receive motive force from an external drive motor;

a guide wheel mounted between the first side wall and the second side portion of the second side wall, opposite the vertical opening from the drive wheel, by a second axle, the guide wheel having a concave outer perimeter that corresponds to and guides the rope through the receptacle as the rope is driven by the drive wheel;

a first movable positioning mechanism disposed on the first side portion and configured to move the drive wheel closer toward the guide wheel;

a second movable positioning mechanism disposed on the second side portion and configured to move the guide wheel closer toward the drive wheel; and one or more handles extending from the first end wall and/or the second end wall, the one or more handles sized and adapted to be gripped by at least one hand of the single user.

2. The apparatus in accordance with claim 1, wherein the friction-bearing outer perimeter of the drive wheel includes an elastomeric ring that defines the outer perimeter.

3. The apparatus in accordance with claim 1, further comprising a drive motor coupled with the drive shaft to control the drive wheel.

4. The apparatus in accordance with claim 3, wherein the drive motor includes a portable drill.

5. The apparatus in accordance with claim 3, wherein the drive motor is mounted to an outer surface of the receptacle.

6. The apparatus in accordance with claim 1, wherein the one or more handles are configured to allow the at least one hand to control a position and orientation of the apparatus.

7. A portable rope drive and guiding apparatus operable by a single user, the apparatus comprising:

a receptacle defined by a first side wall, a second side wall, a first end wall and a second end wall, the second side wall having a vertical opening between a top edge and a bottom edge, the vertical opening providing a first side portion and a second side portion of the second side wall;

a drive wheel mounted between the first side wall and the first side portion of the second side wall by a first axle, the drive wheel having a friction-bearing outer perimeter to drive the rope through the receptacle, the first axle having a drive shaft extending from either the first side wall or the second side wall to drive the drive wheel;

a guide wheel mounted between the first side wall and the second side portion of the second side wall, opposite the vertical opening from the drive wheel, by a second axle, the guide wheel having a concave outer perimeter that corresponds to and guides the rope through the receptacle as the rope is driven by the drive wheel;

a mounting mechanism coupled with the receptacle for mounting the apparatus to the single user;

a first movable positioning mechanism disposed on the first side portion and configured to move the drive wheel closer toward the guide wheel;

a second movable positioning mechanism disposed on the second side portion and configured to move the guide wheel closer toward the drive wheel; and one or more handles extending from the first end wall and/or the second end wall, the one or more handles sized and adapted to be gripped by at least one hand of the single user, the one or more handles configured to allow the at least one hand to control a position and orientation of the apparatus.

8. The apparatus in accordance with claim 7, wherein the friction-bearing outer perimeter of the drive wheel includes an elastomeric ring that defines the outer perimeter.

9. The apparatus in accordance with claim 7, further comprising a drive motor coupled with the drive shaft to control the drive wheel.

10. The apparatus in accordance with claim 9, wherein the drive motor includes a portable drill.

11. The apparatus in accordance with claim 9, wherein the drive motor is mounted to an outer surface of the receptacle.

12. A portable rope drive and guiding apparatus operable by a single user, the apparatus comprising:

a receptacle defined by a first side wall, a second side wall, a first end wall and a second end wall, the second side wall having a vertical opening between a top edge and a bottom edge, the vertical opening providing a first side portion and a second side portion of the second side wall;

a drive wheel mounted between the first side wall and the first side portion of the second side wall by a first axle, the drive wheel having a friction-bearing outer perimeter to drive the rope through the receptacle, the first axle having a drive shaft extending from either the first side wall or the second side wall to drive the drive wheel;

a drive motor coupled with the drive shaft to control the drive wheel;

a guide wheel mounted between the first side wall and the second side portion of the second side wall, opposite the vertical opening from the drive wheel, by a second axle, the guide wheel having a concave outer perimeter that corresponds to and guides the rope through the receptacle as the rope is driven by the drive wheel;

a first movable positioning mechanism disposed on the first side portion and configured to move the drive wheel closer toward the guide wheel;

a second movable positioning mechanism disposed on the second side portion and configured to move the guide wheel closer toward the drive wheel; and one or more handles extending from the first end wall and/or the second end wall, the one or more handles sized and adapted to be gripped by at least one hand of the single user, the one or more handles configured to allow the at least one hand to control a position and orientation of the apparatus.

13. The apparatus in accordance with claim 12, wherein the drive motor includes a portable drill.

14. The apparatus in accordance with claim 12, wherein the drive motor is mounted to an outer surface of the receptacle.

15. The apparatus in accordance with claim 12, wherein the drive motor is controlled by a control signal received via a wireless communication channel.

16. The apparatus in accordance with claim 15, wherein the wireless communication channel communicates the control signal according to a wireless transmission protocol.

* * * * *